US012209815B2

(12) United States Patent
Berger et al.

(10) Patent No.: US 12,209,815 B2
(45) Date of Patent: Jan. 28, 2025

(54) FLAT HEAT EXCHANGER TUBE

(71) Applicant: ESTRA AUTOMOTIVE SYSTEMS LUXEMBOURG S.À.R.L., Hautcharage (LU)

(72) Inventors: Thierry Berger, Thionville (FR); Vincent Nautet, Luxembourg (LU); Richard Cipriano, Doncourt-lès-Conflans (FR); Hervé Damotte, Longwy (FR); Chris Calhoun, Bertrange (LU)

(73) Assignee: ESTRA AUTOMOTIVE SYSTEMS LUXEMBOURG S.A.R.L., Hautcharage (LU)

( * ) Notice: Subject to any disclaimer, the term of this patent is extended or adjusted under 35 U.S.C. 154(b) by 274 days.

(21) Appl. No.: 17/778,968

(22) PCT Filed: Nov. 25, 2020

(86) PCT No.: PCT/EP2020/083342
§ 371 (c)(1),
(2) Date: May 23, 2022

(87) PCT Pub. No.: WO2021/105200
PCT Pub. Date: Jun. 3, 2021

(65) Prior Publication Data

US 2023/0025367 A1 Jan. 26, 2023

(30) Foreign Application Priority Data

Nov. 25, 2019 (LU) ..... LU101492

(51) Int. Cl.
*F28F 1/02* (2006.01)
*F28D 1/053* (2006.01)

(52) U.S. Cl.
CPC ..... *F28F 1/022* (2013.01); *F28D 1/05383* (2013.01); *F28F 2225/04* (2013.01)

(58) Field of Classification Search
CPC .... F28F 1/022; F28F 2225/04; F28D 1/05383
See application file for complete search history.

(56) References Cited

U.S. PATENT DOCUMENTS 4,470,452 A * 9/1984 Rhodes ..... F28D 1/0391 165/DIG. 486
5,185,925 A * 2/1993 Ryan ..... B21C 37/14 29/890.035

(Continued)

FOREIGN PATENT DOCUMENTS

EP 3399265 A1 11/2018
EP 3521746 A1 8/2019
EP 3690372 A1 8/2020

OTHER PUBLICATIONS

International Search Report and Written Opinion issued on Feb. 9, 2021 in corresponding International Patent Application No. PCT/EP2020/083342; 10 pages.

*Primary Examiner* — Raheena R Malik
(74) *Attorney, Agent, or Firm* — Maier & Maier, PLLC

(57) ABSTRACT

A flat heat exchanger tube is formed from a single metal strip and comprising two opposite spaced apart broad sides in a thickness direction of said tube and two opposite nose-forming narrow sides in a width direction of said tube. The strip has two longitudinal edges, the first longitudinal edge being contiguous to the first broad side and the second longitudinal edge being contiguous to the second broad side. The two longitudinal edges of the strip are joined together at a first one of the narrow sides, both longitudinal edges being convex-shaped so that the first edge forms an outer convex (Continued)

bend and the second edge forms an inner convex bend that fits in the outer convex bend and conforms to its internal curvature.

14 Claims, 2 Drawing Sheets

(56) References Cited

U.S. PATENT DOCUMENTS 5,439,050 A * 8/1995 Waterman ..... F24H 8/00 165/170
6,192,977 B1 * 2/2001 Dey ..... B21C 37/155 138/168
6,209,202 B1 * 4/2001 Rhodes ..... B21C 37/151 165/177
6,241,012 B1 6/2001 Yu et al.
6,666,265 B1 * 12/2003 Kato ..... B21D 53/04 165/177
7,117,936 B2 * 10/2006 Ohata ..... F28F 9/0202 165/177
7,487,589 B2 * 2/2009 Smith ..... F28F 3/025 228/183
7,665,512 B2 * 2/2010 Brost ..... F28D 1/0391 165/177
7,921,559 B2 * 4/2011 Zobel ..... B21C 37/22 29/890.032
8,091,621 B2 * 1/2012 Zobel ..... B21C 37/157 165/177
8,281,489 B2 * 10/2012 Zobel ..... B23K 31/02 83/42
8,353,335 B2 * 1/2013 Ploppa ..... F28F 1/40 165/177
8,438,728 B2 * 5/2013 Zobel ..... B21C 37/22 165/177
8,683,690 B2 * 4/2014 Zobel ..... B21C 37/151 165/177
8,726,508 B2 * 5/2014 Zobel ..... B21C 37/151 165/177
8,925,625 B2 * 1/2015 Ninagawa ..... F28D 1/0391 165/161
2005/0006082 A1 1/2005 Brost et al.
2010/0206533 A1 8/2010 Sakakibara et al.
2013/0263451 A1 10/2013 Kunz et al.
2020/0217589 A1 * 7/2020 Kim ..... B21D 53/06
2020/0240714 A1 * 7/2020 Marchadier ..... F28F 1/022
2023/0025367 A1 * 1/2023 Berger ..... F28D 1/0358

* cited by examiner

FLAT HEAT EXCHANGER TUBE

FIELD

The present invention generally relates to the field of heat exchangers and more specifically to flat tubes used in such heat exchangers.

BACKGROUND

A heat exchanger such as a radiator, condenser or evaporator, for use in an automotive vehicle typically includes an inlet tank (or header), an outlet tank and a plurality of tubes extending between the tanks and hydraulically connecting the tanks for fluid flow there between. External fins are provided on the tubes to increase heat transfer to ambient air. The tanks, tubes and fins are typically assembled into a unitary structure and brazed.

As is known, a first heat transfer fluid, e.g. a liquid coolant or a two-phase refrigerant, flows from the inlet tank to the outlet tank through the plurality of tubes. The first heat transfer fluid is in contact with the interior surfaces of the tubes while a second heat transfer fluid, such as ambient air, is in contact with the exterior surfaces of the tubes. Where a temperature difference exists between the first and second fluids, heat is transferred from the higher temperature fluid to the lower temperature fluid through the walls of the tubes. Internal fins are provided within the passageways of the tubes to increase the surface area available for heat transfer, as well as to increase the structural integrity of the tubes. The internal fins extend substantially the length of the tubes and define a plurality of channels or ports for the flow of a heat transfer fluid from one header to the other.

Heat exchanger tubes having a plurality of channels are also known as multi-port tubes. A known method of manufacturing multi-port tubes is by extruding a billet of deformable heat conductive material through a die. The extrusion process allows for the formation of the internal fins to have intricate geometric features to improve heat transfer efficiency that other known manufacturing process could not readily provide. However, the extrusion process is known to be expensive because of the need to frequently replace the extrusion die in order to maintain the desired dimensions of the intricate geometric features. Extruded tubes are also prone to corrosion attacks from road salt and acidic rain and require extensive corrosion inhibition coatings for motor vehicle applications, which add to the complexity of manufacturing and cost.

Another known method of forming multi-port tubes is by folding a sheet strip of pliable heat conductive material. Typically, a flat elongated sheet strip of metallic material is folded to form a tube having multiple ports defined by the internal corrugated folds. The internal corrugated folds form the internal fins that define the shape and size of the ports. Folded tubes provide numerous advantages over extruded tubes in terms of lower cost and ease of manufacturing for the tube itself as well as for the final assembly of the heat exchanger. One advantage is that a folded tube can be formed from a thin sheet of clad aluminum, which offers superior corrosion protection without the need for applying additional coatings.

However, a known shortcoming of folded tubes is that the leading nose of the folded tube is prone to damage since the thickness, or gage, of the leading nose is the same as that of the thin sheet of clad aluminum material that the folded tube is fabricated from. The leading nose of the tube is typically oriented toward the front of the motor vehicle and exposed to incoming air for increase heat transfer efficiency as the vehicle moves in the forward direction. In this configuration, the leading nose is susceptible to impact damage from road hazards such as rocks and debris, as well as corrosion damage from environmental hazards such as acidic rain, road salt, and wind friction.

To address this problem, it is known to arrange a plastic grid before the heat exchanger, with an appropriate mesh size to retain rocks and debris.

An alternative solution is to reinforce the leading nose of the folded tubes, as e.g. disclosed in US 2013/0263451 and US 2005/0006082.

US 2010/206533 discloses a flat condenser tube, wherein tube and inner fin are formed from a single clad plate. One longitudinal edge of the plate forms a first nose of the tube, delimiting one flat portion, and the other longitudinal edge of clad is inside the tube, forming the end section of the internal fin, and arranged opposite to the other longitudinal edge.

U.S. Pat. No. 6,241,012 discloses a condenser tube manufactured from a single metal strip, which is folded to form a plurality of flow channels and the two longitudinal edges are joined at the same narrow side.

The object of the present invention is to provide a flat heat exchanger tube formed of improved design, having namely a reinforced front nose.

SUMMARY

The present invention relates to a flat heat exchanger tube formed from a single metal strip, the tube comprising two opposite spaced apart broad sides in a thickness direction of the tube and two opposite nose-forming narrow sides in a width direction of the tube.

The strip has two longitudinal edges, the first longitudinal edge being contiguous to the first broad side and the second longitudinal edge being contiguous to the second broad side.

The two longitudinal edges of the strip are joined together at a first one of the narrow sides, both longitudinal edges being convex-shaped so that the first edge forms an outer convex bend and the second edge forms an inner convex bend that fits in the outer convex bend and conforms to its internal curvature.

It will be appreciated that the second longitudinal edge has a terminal section that is bent to extend across the thickness of the tube to form a closed edge channel delimited in the width direction by the inner convex bend and by the terminal section.

The present tube thus has a folded structure with a double wall on the outside of the leading edge to ensure no cracks from sharp debris. Once the nose has taken the initial impact the tube is deformed. In conventional designs, with only a double walled nose, the problem arises that the impact energy cannot be absorbed by the double nose, especially when the port width is increased. It is this deformation which results in leakages. The triple wall structure provided by the present invention incorporates a third wall, i.e. the terminal section, which allows the tube nose to deform, but not break. This third wall, i.e. the terminal section, acts like a crash spring absorbing the remaining energy of the impact and stopping the deformation.

In an embodiment, the inner convex bend is U-shaped and the terminal section comprises a leg that extends across the thickness of the tube and a foot that bears against the inner side of the U-shaped inner convex bend.

In another embodiment, the terminal section comprises a straight leg that is bent back to have its extremity in abutment against the inner side of the inner convex bend.

In general, the second broad side may have a bend toward the tube interior connecting the second longitudinal edge. In particular, the bend toward the tube interior may have a size corresponding roughly to the strip thickness, and the outer bend of the first longitudinal edge has its terminal edge in close fit with said bend, coming flush with the second broad surface.

Conveniently, the strip is cladded on both sides with a thin layer of brazing material. This permits bindings tube regions where distinct strip portions are in contact with one another, in particular at the first nose, where the bent sections are in intimate contact with one another, or to unite the terminal section with strip portion on which it bears. In general, the strip may be made of aluminum or aluminum alloy. The cladding material may be an aluminum alloy such as AA4343 and the like.

The tube may have a fold formed in one of the broad sides and extending in thickness direction to the opposite broad side. This fold thus separates the inner tube volume into two chambers. In embodiments, there is only one such fold, and thus only two chambers. In other embodiments there may be other folds, forming sub-chambers.

It should however be noted that the present design is of particular advantage for chambers or ports of relatively broad cross-section.

The tubes may have a width greater than 4 mm, e.g. of 4 to 15 mm, and a internal height between 1.0 and 2.5 mm. The cross-sectional area of the chambers may typically be between 4.0 and 38 $mm^2$.

In general, the present design is suitable for tubes having lager chambers, where the ratio chamber height over chamber width is less than 1.

The present folded, flat tube has a number of benefits. The inventive 3 layer nose design provides the desired resistance improvement compared to state of the art folded tubes, hence meeting benchmark targets. The resistance to sharp projectiles is improved. The use of an expensive plastic grid is not required. The design is particularly robust for tubes with large open port (chamber) structures, e.g. for radiator tubes. The tube can be manufactured using conventional manufacturing (namely folding) technologies, with minor modifications of current roll sets.

The present tube design has been particularly developed for radiator tubes, in which case there is no turbulator or internal fin (corrugated sheet) inside the tube.

These and other embodiments are also recited in the attached dependent claims.

According to another aspect, the invention concerns a radiator comprising an exchanger core with a plurality of parallel flat heat exchanger tubes as disclosed herein, the tubes in communication at one end with a first tank and the other end with a second tank.

BRIEF DESCRIPTION OF THE DRAWINGS

The present invention will now be described, by way of example, with reference to the accompanying drawings, in which.

DETAILED DESCRIPTION

Figure 1:
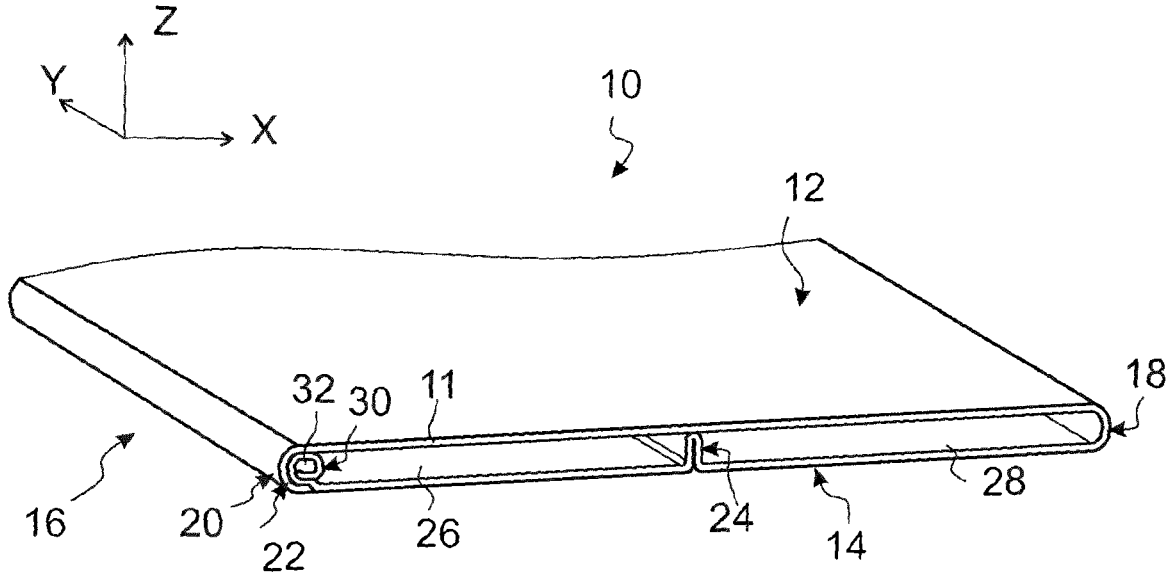
FIG. 1: is a perspective view of a flat heat exchanger tube according to an embodiment of the invention.

FIG. 1 is a perspective view of a first embodiment of the present flat heat exchanger tube 10. Such a tube 10 will be advantageously used in a heat exchanger, in particular a radiator, as is known by those skilled in the art. For example, a plurality of parallel such tubes 10 may be secured between two tanks equipped with header plates to convey a fluid (single or two-phase) between the tanks, which fluid may be cooled by a second fluid (such as air) passing over the outside of the tubes 10. Suitable fins (not shown), including louvered and plate fins, may be provided at the periphery of the tubes 10 to facilitate heat exchange between the fluid in the tubes 10 and the second fluid, as is generally well known.

The present tube 10 may be advantageously produced from a single deformable metal sheet strip 11 (or plate) of limited sheet thickness, e.g. made of aluminum sheet, through a number of forming steps, namely folding steps. The initial shape of the steel strip is normally rectangular or square. Any shape of the present folded tube's 10 cross-section can be produced by providing progressive form rollers of suitable shape. Apparatuses and processes for forming heat exchanger tubes by folding, and in particular tube mill equipment, are well known in the art and can be adapted by the skilled person to produce the present heat exchanger tubes.

Tube 10, in its final configuration after forming, has two opposite broad sides 12, 14 and two opposite narrow sides 16, 18, also referred to as nose.

The broad sides 12, 14 delimit the thickness of tube 10 and thus extend in thickness direction Z. The narrow sides 16, 18 delimit the width of the tube in width direction X. The narrow sides extend in the longitudinal direction of the tube 10, along direction Y. In FIG. 1, only part of the tube 10 is shown from one of its open ends, but it is clear that the length of the tube 10 will generally by substantially larger than its width. As can be seen, the strip 11 is folded so that the longitudinal edges 20, 22 of the strip 11 meet at one narrow side, namely nose 16, thereby peripherally closing the tube 10.

As will be understood, the term "longitudinal edge" is used herein to designate a longitudinally extending region or band at the edge of the strip, which may also be referred to as border region or margin region.

A connection 24 is arranged between the two broad sides 12, 14 and divides the heat exchanger tube 10 into two chambers 26, 28 having the same cross-sectional size when the connection 24 is situated roughly in the center of the tube, between the narrow sides 16, 18. It would be within the scope of the present invention, however, to locate the connection 24 outside of the center, in which case the chambers 26, 28 could have different cross-sectional sizes. The connection 24 is achieved by a fold of the strip 11 in the thickness direction.

In principle, additional folds may also be provided to variously subdivide the chambers 34, 36 as desired, whereby more than two chambers 34, 36 may be produced from the sheet strip 11.

However, the particular intention of the present design is to confer strength to a tube having large chambers. The tubes may have a width (direction X) greater than 4 mm, e.g. of 4 to 15 mm, and an internal height (direction Z) between 1.0 and 2.5 mm. The cross-sectional area of the chambers may typically be between 4.0 and 38 $mm^2$.

In practice, when the heat exchanger is mounted in a car for example, the tube nose turned towards the front of the car is prone to damage due to road hazards (impacts by rocks and debris) and to corrosion, as explained above.

In the present embodiment, the narrow edge 16 is designed to be facing the front of the car, and may thus be referred to as front or leading nose. The other narrow edge 18 will then be the trailing nose.

The front nose 16 is reinforced by way of a multilayer design. The strip 11 has two longitudinal edges, each contiguous to a respective broad side. The longitudinal edges 20, 22 are joined together at the front nose 16, both longitudinal edges 20, 22 being convex-shaped so that a first edge 20 forms an outer convex bend 21 and the second edge 22 forms an inner convex bend 23 that fits therein and adopts the internal curvature of the first edge 20. The bends 21 and 23 may be curve or curvilinear shaped, in particular circular or U-shaped. The mating profiles of the inner and outer bends 21 and 23 provides an intimate contact between these that will allow soldering/brazing them together.

Referring to the orientation in FIG. 1, the top broad side 12 ends is contiguous the first longitudinal edge 20 that forms the outer convex bend 21, whereas the bottom broad side 14 is contiguous with the second longitudinal edge 22 forming the inner convex bend 23.

It will be appreciated that the second longitudinal edge 22 has a terminal section 30, after the inner convex bend 23, that bends back onto the inner side of the inner convex bend 23 to form a closed edge channel 32.

As will be understood, the term "terminal section" is used herein to designate a narrow end region (or end margin) within the longitudinal edge, contiguous to the very edge of the sheet.

Figure 2:
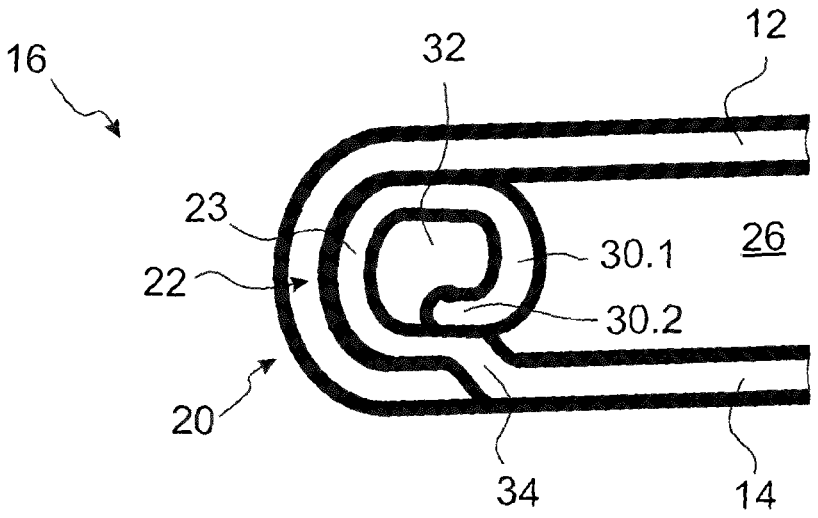
FIG. 2: is a detail view of the front nose of the heat exchanger tube of FIG. 1.

As better seen in FIG. 2, the second longitudinal edge 22 is the part of the strip 11 forming the bottom broad side 14 that ends at the front nose 16. The second longitudinal edge 22 comprises the convex bent section 23 connected on one side to the bottom broad side 14, via a short bent section 34. The convex bent section 23 describes a convex curve, here substantially U-shaped, matching the curvature of the outer bend 21, and extending from the bottom broad side 14 to the inner side of the top broad side 12. The second longitudinal edge 22 ends with the terminal section 30, that extends substantially in the tube thickness direction Z from the top broad side 12 to the bottom broad side 14, thus bending back onto itself. The terminal section 30 extends across the thickness direction to come against the inner side of the U-shaped bent section 23. Here the terminal section 30 has a leg 30.1 and a foot 30.2.

The terminal section 30 extending in the thickness direction, in particular via leg 30.1, brings additional mechanical resistance in the rearward region of the nose 16. There is thus three layers of material at the nose 16, the two superposed front layers formed by the bent sections 21 and 23, and one at the back, i.e. the leg 30.1. The channel 32 arranged between the two bend sections and the terminal section will allow for mechanical deformation of the bent sections 21, 23, without direct contact with the terminal section 30. As a matter of fact, the terminal section 30 extending in thickness direction and spaced from the bent sections 21, 23, permits absorbing part of the front nose deformation in case of shocks. The front nose is thus capable of absorbing more energy, without leading to leakage.

The front nose configuration of the present tube is of particular interest for tubes with coolant chambers of relatively large cross-section. This is the case in the shown embodiment where the tube has only two chambers 26 and 28, and thus has globally less transversal rigidity than a tube having a multiplicity of chambers divided by folds similar to fold 24.

Figure 3:
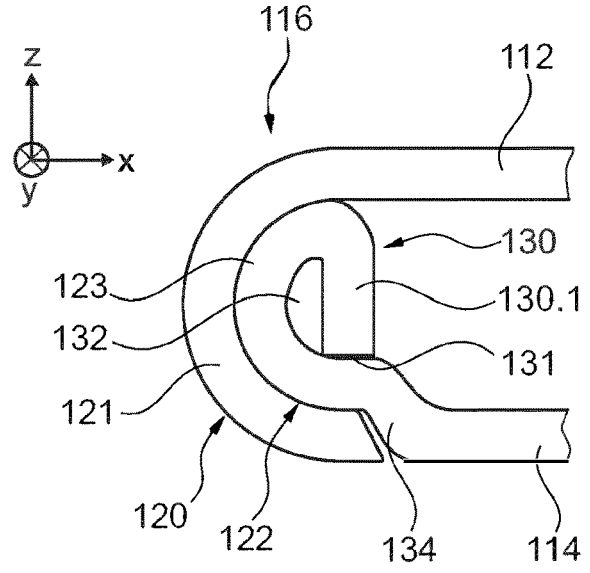
FIG. 3 is a cross-sectional view of the front nose of heat exchanger tubes according to further embodiments of the invention.

Another embodiment of the present front nose configuration is shown in FIG. 3. Same or similar elements are indicated by same reference signs, augmented by 100 as compared to the embodiment of FIGS. 1 and 2. Similar to the front nose configuration of FIG. 2, the nose 116 is formed by the joining of the longitudinal edges 120, 122, both longitudinal edges 120, 122 being convex-shaped so that a first edge 120 forms an outer convex bend 121 and the second edge 122 forms an inner convex bend 123 that fits therein and adopts the internal curvature of the first edge 120. The terminal section 130 of the second longitudinal edge 122 is bent back to extend across the tube substantially in the thickness direction. Here the terminal section 130 has a straight section 130.1, the edge 131 of which is in abutment against the base of the convex bent section 123, just after bend 134. The gap between the convex bent section 123 and the terminal section 130 forms a closed edge channel 132.

Figure 4:
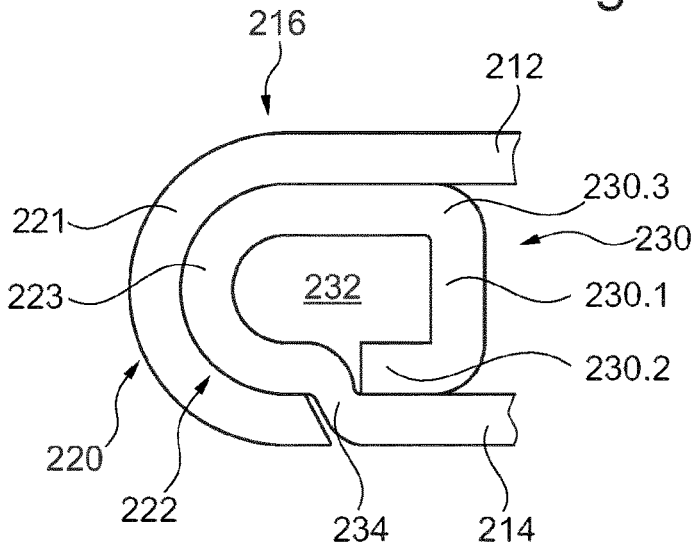
FIG. 4 is a cross-sectional view of the front nose of heat exchanger tubes according to further embodiments of the invention.

Turning to FIG. 4, a further embodiment is illustrated. Same or similar elements are indicated by same reference signs, augmented by 200 as compared to the embodiment of FIGS. 1 and 2. The nose 216 is formed by the joining of the longitudinal edges 220, 222. Both longitudinal edges 220, 222 are convex-shaped so that a first edge 220 forms an outer convex bend 221 and the second edge 222 forms an inner convex bend 223 that fits therein and conforms to the internal curvature of the first edge 220. The terminal section 230 has a kind of C shape, where the interior of the C faces the inner side of inner bend 223. That is, the inner bent section 223 has an essentially circular shape and the terminal section 230 has a first straight section 230.3 along the inner side of the top broad side 212, a leg 230.1 extending in thickness direction and a foot 230.2 extending along the inner side of the bottom broad side 214, towards the bend 234. The foot ends by the bend 234 before the inner bent section 223.

Figure 5:
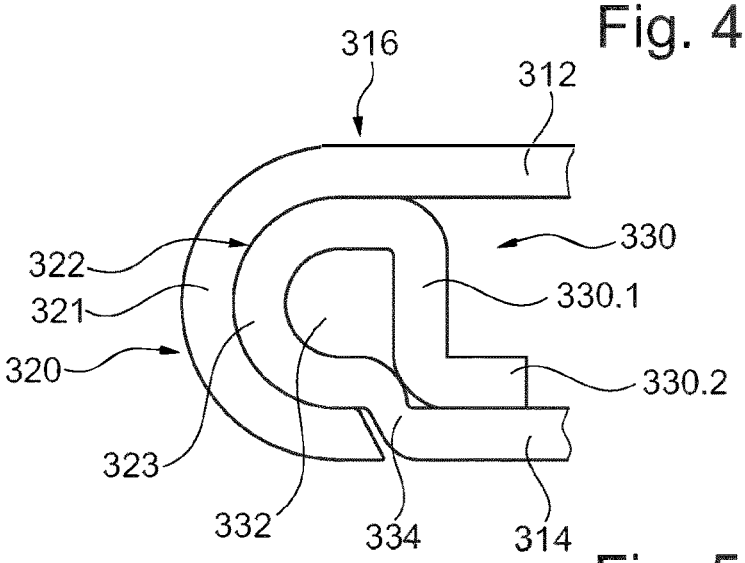
FIG. 5 is a cross-sectional view of the front nose of heat exchanger tubes according to further embodiments of the invention.

A fourth embodiment of the present tube is shown in FIG. 5. Same or similar elements are indicated by same reference signs, augmented by 300 as compared to the embodiment of FIGS. 1 and 2. The nose 316 is formed by the joining of the longitudinal edges 320, 322. Both longitudinal edges 320, 322 are convex-shaped so that a first edge 320 forms an outer convex bend 321 and the second edge 322 forms an inner convex bend 323 that fits therein and conforms to the internal curvature of the first edge 320. The inner bent section 323 has a generally curved shape and the terminal section 330 extends at the base of the inner bend 323, forming a D-shaped edge channel 332. The terminal section 330 has a straight leg 330.1 extending substantially in the thickness direction and a perpendicular foot 330.2 extending along the inner side of the bottom broad side 314, away from the inner convex bend 323. The leg 330.1 is positioned at the basis of the inner convex bend, against bend 334.

It remains to be noted that to strengthen the tube, the regions where two parts of the strip 11 lie against one another are conventionally bound together. This is the case at the first nose at the interface between the outer and inner convex bent sections, or also at the interface between the terminal section with other sections of the strip, and also at the fold 24. The binding is typically obtained by brazing. Therefore, the strip is cladded on both sides with a thin layer of brazing material.

The invention claimed is:

1. A flat heat exchanger tube formed from a single metal strip, comprising: two opposite spaced apart broad sides in a thickness direction of said tube and two opposite nose-forming narrow sides in a width direction of said tube;

wherein the strip has two longitudinal edges, the first longitudinal edge being contiguous to the first broad side and the second longitudinal edge being contiguous to the second broad side;

said two longitudinal edges of the strip are joined together at a first one of the narrow sides, both longitudinal edges being convex-shaped so that the first edge forms an outer convex bend and the second edge forms an inner convex bend that fits in the outer convex bend and conforms to its internal curvature;

the second longitudinal edge has a terminal section that is bent to extend across the thickness of the tube to form a closed, edge channel delimited in the width direction by the inner convex bend and by the terminal section;

wherein the terminal section comprises a leg that extends across the thickness of the tube and a foot that bears against the inner side of the second broad side, the contact surface between the foot and the second broad side being superior to the thickness of the leg, the foot being brazed against the second broad side; and the tube comprising only two flow chambers, separated by a fold formed in one of the broad sides and extending in thickness direction to the opposite broad side.

2. The flat heat exchanger tube according to claim 1, wherein the second broad side has a bend toward the tube interior connecting the second longitudinal edge.

3. The flat heat exchanger tube according to claim 2, wherein said bend toward the tube interior has a size corresponding roughly to the strip thickness, and the outer bend of the first longitudinal edge has its terminal edge in close fit with said bend, coming flush with the second broad surface.

4. The flat heat exchanger tube according to claim 1, wherein the inner convex bend is U-shaped and wherein the foot bears against the inner side of the U-shaped inner convex bend.

5. The flat heat exchanger tube according to claim 1, wherein the terminal section is substantially C-shaped, the interior of the C facing the inner side of inner bend, wherein the inner bent section has an essentially circular shape and the terminal section has a first straight section along the inner side of the first broad side, wherein the leg extends in the thickness direction and wherein the foot extends along the inner side of the second broad side, towards the bend.

6. The flat heat exchanger tube according to claim 5, wherein the foot ends by the bend before the inner bent section.

7. The flat heat exchanger tube according to claim 1, wherein the inner bent section has a generally curved shape and the terminal section extends at the base of the inner bend; wherein the leg is a straight leg extending substantially in the thickness direction and wherein the foot is perpendicular to the leg and extends along the inner side of the second broad side, away from the inner convex bend.

8. The flat heat exchanger tube according to claim 1, wherein the terminal section is sealingly bound to the inner convex bend or the second broad side.

9. The flat heat exchanger tube according to claim 1, wherein the strip is cladded on both sides with a thin layer of brazing material.

10. The flat heat exchanger tube according to claim 1, wherein the chamber adjacent the edge channel has a height-to-width ratio of less than 1.

11. The flat heat exchanger tube according to claim 1, wherein the leg extends perpendicularly, across the thickness of the tube, and wherein the contact surface between the foot and the second broad side has a thickness that is at least twice the thickness of the leg.

12. The flat heat exchanger tube according to claim 11, wherein the tube inner volume does not comprise a corrugated inner fin.

13. The flat heat exchanger tube according to claim 7, wherein the leg is positioned at the base of the inner convex bend, against the bend.

14. A radiator, comprising: an exchanger core with a plurality of parallel flat heat exchanger tubes as recited in claim 1, the tubes in communication at one end with a first tank and the other end with a second tank.

* * * * *